United States Patent [19]

Tokita

[11] 3,949,901

[45] Apr. 13, 1976

[54] SHIPPING BAG

[75] Inventor: Shinko Tokita, Tokyo, Japan

[73] Assignee: National Marineplastic, Ltd., Tokyo, Japan

[22] Filed: Feb. 6, 1975

[21] Appl. No.: 547,453

[52] U.S. Cl. ..... 222/94; 150/.5; 220/22; 220/71

[51] Int. Cl.[2] ..... B65D 35/22

[58] Field of Search ..... 222/92–94, 222/105, 107, 183, 173, 185, 527–530; 150/.5, 1; 220/22, 71

[56] References Cited

UNITED STATES PATENTS

| | | | |
|---|---|---|---|
| 3,011,682 | 12/1961 | Kus | 222/105 |
| 3,151,650 | 10/1964 | Beck | 150/1 |
| 3,724,497 | 4/1973 | Federer et al. | 222/94 |

FOREIGN PATENTS OR APPLICATIONS

| | | | |
|---|---|---|---|
| 649,422 | 9/1962 | Canada | 150/1 |

*Primary Examiner*—Robert B. Reeves
*Assistant Examiner*—H. Grant Skaggs

[57] ABSTRACT

A shipping bag for powder or granular material which is comprised of a square external bag of flexible sheet having an inlet at its top end and an outlet at its bottom end and a cylindrical internal casing of the same material as that of the external bag, said cylindrical internal casing at its circumference being joined with an inner wall of the external bag to form four corner spaces through four partitions of unjoined circumference of the internal casing which are respectively provided with a number of slits in multistage for passing the material into the corner spaces.

4 Claims, 5 Drawing Figures

SHIPPING BAG

BACKGROUND OF THE INVENTION

This invention relates to an improved shipping bag for powder or granular material.

To obtain a desired labor saving effect in the transportation of the powder or granular material, there has been a bulk cargo system where the powder material is directly loaded on the transportation means such as ship, vehicle and the like which are likely confronted with a risk of upsetting when the ship or vehicle lists on running with movement of the goods along the listing direction.

In order to avoid the foregoing risk, a various types of the shipping containers in convenient shape and size for transportation have been proposed and practised.

The shipping container of square shape including cubic or rectangular shape is preferred to maximize the load capacity, notwithstanding the conventional cubic or rectangular container is insufficient to obtain a maximum load capacity as the container when filled with the material is deformed under the pressure of the material into a cylindrical shape which when stacked in the hatch produces undesired spaces with reduction of the load capacity.

To improve the above disadvantages and inconveniences, the inventor has developed a new shipping container which even when filled with the material is susceptible to maintain a prototype of the square container and generally comprises a square bag made of soft and tough sheet having an inlet at its top end and an outlet at its bottom end. Four corner portions of the square bag are partitioned respectively through four rectangular sheet pieces to form four corner spaces and individual sheet piece at its opposite ends is joined with the adjoining inner walls of the square bag and provided with a number of slits in multistage for passing the material into the corner space so that the bag even when filled with the material is maintained in a square form.

However, the shipping container of the aforementioned type has confronted with inconvenience in manufacture since the partition piece must be strongly joined with the inner walls of the square bag to avoid removal of the partition piece therefrom to be caused under the pressure of the material filled in the bag.

To improve the foregoing deffects, there is provided a further improved bag which is comprised of a square external bag of flexible sheet having an inlet at its top end and an outlet at its bottom end and a cylindrical internal casing of the same material as that of the external bag. The cylindrical internal casing at its circumference is joined with four inner walls of the external bag to form four corner spaces through four partitions of unjoined circumference of the internal casing and the partitions are respectively provided with a number of slits in multistage for passing the material uniformly into the corner spaces so that the bag when filled with the material retains a prototype of the square bag for convenient stacking of the shipping bags with an enhanced load capacity. The shipping bag of this type is very convenient in manufacture and there is no likelihood of removal of the internal casing from the bag under the pressure of the filled material.

SUMMARY OF THE INVENTION

It is, therefore, a general object of the invention to provide a novel shipping bag of simple structure but having an improved strength and prototype retaining property with an enhanced load capacity which is also convenient in manufacture.

A principal object of the invention is to provide a shipping bag for powder or granular material which is comprised of a square external bag of flexible sheet having an inlet at its top end and an outlet at its bottom end and a cylindrical internal casing of the same material as that of the external bag, said cylindrical internal casing at its circumference being joined with four inner walls of the external bag to form four corner spaces through four partitions of unjoined circumference of the casing which are respectively provided with a number of slits in multistage for passing the material into the corner spaces.

Other objects and advantages of the invention will become apparent as the detailed description thereof proceeds.

For a fuller understanding of the present invention reference should now be had to the following detailed description thereof taken in conjunction with the accompanying drawings, wherein:

PREFERRED EMBODIMENT OF THE INVENTION

Figure 1:
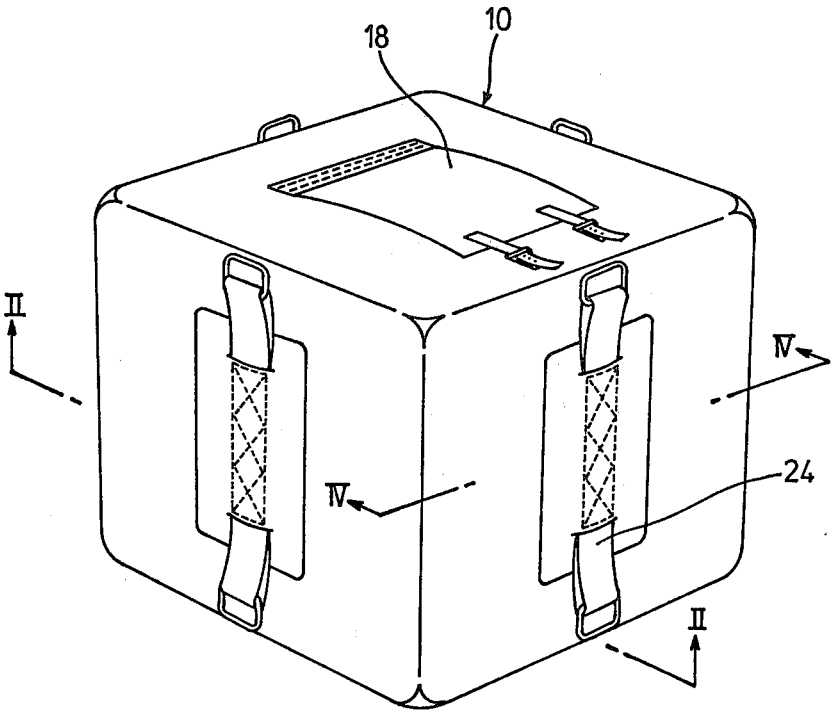
FIG. 1 is a perspective view of the shipping bag in accordance with the present invention.
Figure 2:
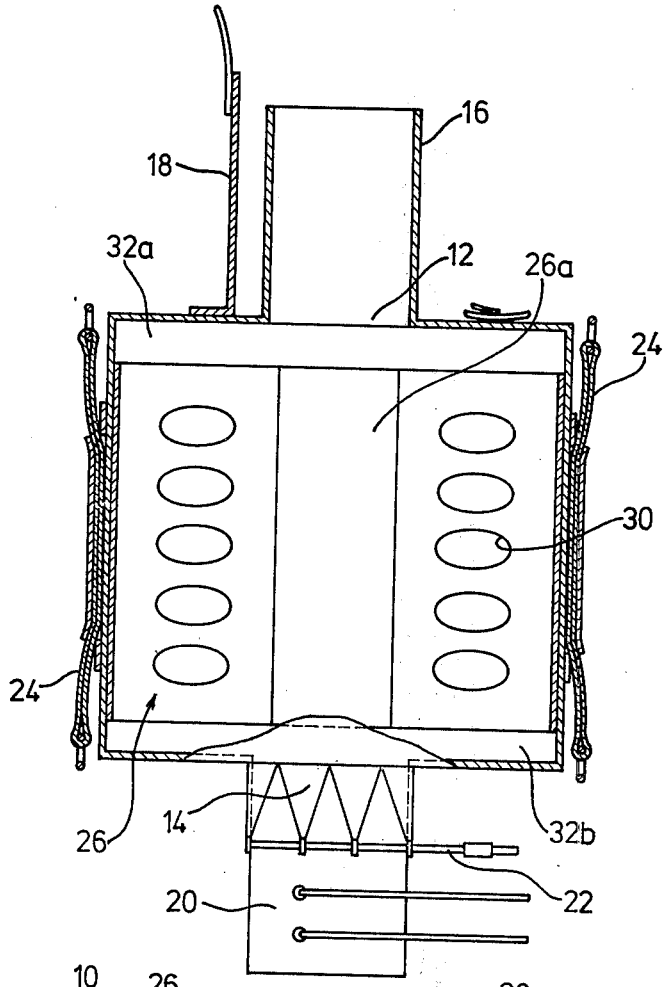
FIG. 2 is a sectional view of the bag taken along the line II—II of FIG. 1 showing an inlet and an outlet in opened positions.
Figure 4:
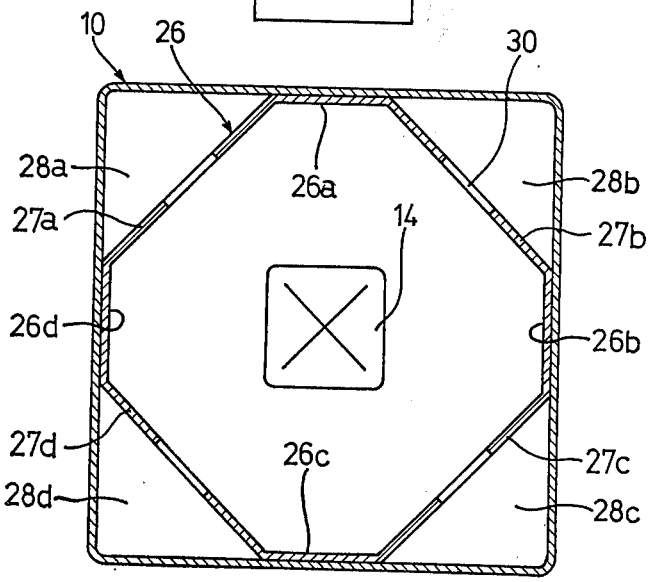
FIG. 4 is a sectional view of the bag taken along the line IV—IV of FIG. 1.
Figure 3:
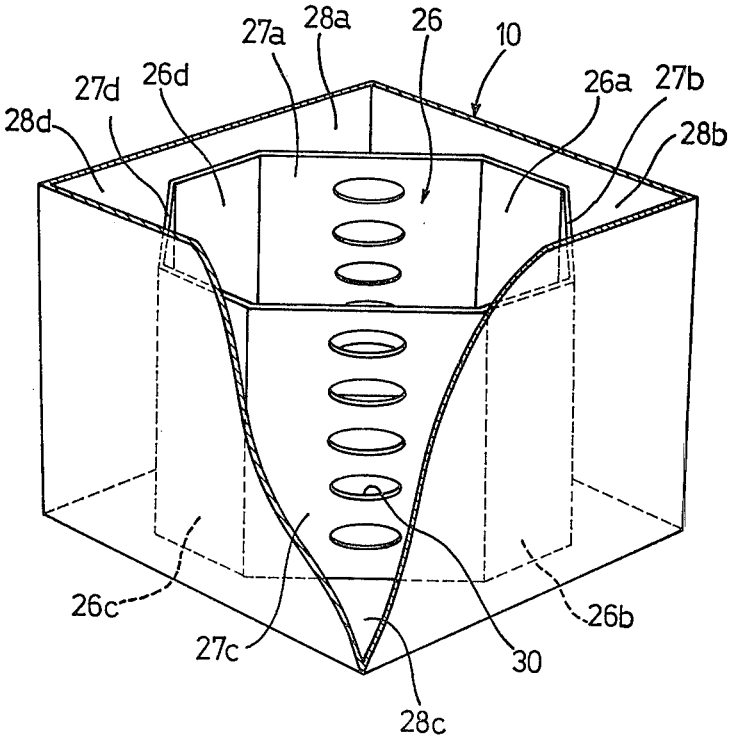
FIG. 3 is a perspective view of the bag of FIG. 1 which is partially broken away to show an internal casing positioned in the bag.

In FIG. 1 to 4, the reference numeral 10 represents a square shipping bag made of plastic and synthetic sheet, for example, PVC tarpaulin, EVA tarpaulin, rubber tarpaulin and canvas tarpaulin which is provided with an inlet 12 at its top end and an outlet 14 at its bottom end. From the inlet 12 is extended a square or cylindrical sleeve 16 of the same material as that of the shipping bag for smooth packing of the material thereinto. Adjacent to the sleeve 16 is positioned a covering 18 for closing the inlet 12 when the sleeve 16 is folded into the inlet. Similarly, from the outlet 14 is extended a square or cylindrical sleeve 20 which is provided with a convenient fastening means 22 as shown in FIG. 2.

The bag 10 at its opposite sides is provided with longitudinally extended lifting belts 24, 24 to which a rope is connected for convenience in loading or unloading of the shipping bag by means of the crane and the like.

In the bag 10 is mounted a cylindrical internal casing 26 of plastic and synthetic sheet which at the positions 26*a*, 26*b*, 26*c* and 26*d* is joined with the inner wall of the bag 10 by means of the welding, bonding or seaming process to form the corner spaces 28*a*, ∞*b*, 28*c* and 28*d* through partitions 27*a*, 27*b*, 27*c* and 27*d* which are provided with a number of slits 30 in multistage through which the corner spaces 28*a*, 28*b*, 28*c* and 28*d* are communicated respectively with the inside of the internal casing 26 so that the material filled in the casing 26 flows uniformly and slowly into the corner spaces 28*a*, 28*b*, 28*c* and 28*d* to retain the prototype of the shipping bag even after filled with the material. Since the material in the internal casing 26 flows slowly and uniformly through the slits 30 into the corner spaces 28*a*, 28*b*, 28*c* and 28*d*, an undesired coagulation of the powder material which is usually developed due to a concentration of the pressure at the corner portions is positively prevented with a smooth delivery operation of the material.

It will be appreciated that the inner casing 26 per se has a strength sufficient to withstand against the pressure of the filled material and may be readily attached to the shipping bag by means of the conventional joint process.

The length of the inner sleeve 26 is preferably shorter than that of the bag 10 so that an upper space 32*a* and a lower space 32*b* are formed in the bag 10 as shown in FIG. 2 for achieving a smooth charging and discharging operation of the material into and from the sleeve 26 as well as the corner spaces 28*a*, 28*b*, 28*c* and 28*d*.

Figure 5:
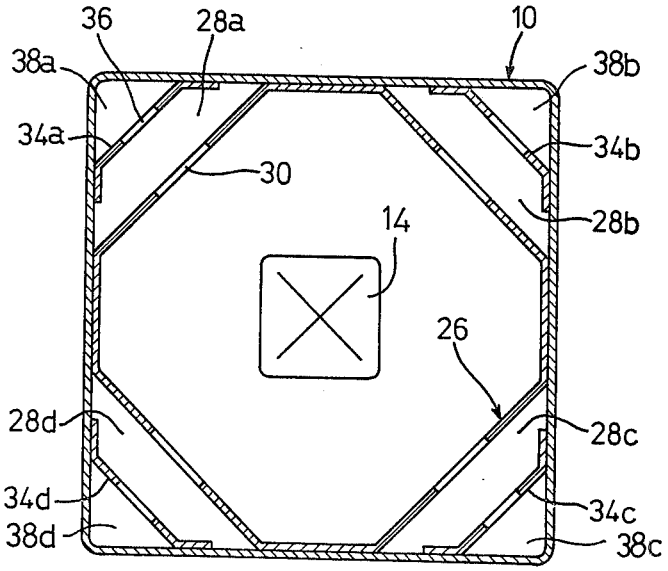
FIG. 5 is a sectional view of the bag similar to FIG. 4 but showing another embodiment.

FIG. 5 shows another embodiment of the invention in which additional partition pieces 34*a*, 34*b*, 34*c* and 34*d* each having a number of slits 36 in multistage are provided to form double corner spaces 38*a*, 38*b*, 38*c* and 38*d* which serves to control movement of the material flown in the corner spaces 28*a*, 28*b*, 28*c* and 28*d* thereby to reduce the pressure of the material against the corner portions of the bag.

As hereinbefore fully described, the shipping container in accordance with the present invention may remarkably enhance the loading capacity when stacked in the hatch of the transportation means such as ship and vehicle with improved labor saving effects.

While certain preferred embodiments of the invention have been illustrated by way of example in the drawings and particularly described, it will be understood that various modifications may be made in the construction and that the invention is no way limited to the embodiments shown. For example, the cylindrical internal casing used in the invention may be formed either by extruding into a single sleeve or seaming a sheet into a sleeve.

What I claim is:

1. A shipping bag for powdered granular material which comprises an outer enclosure of flexible sheet material having an inner wall defining a chamber of rectangular cross section, said inner wall having four corner portions and planar sections intermediate said corner portions, the diametric distance between opposed planar sections being less than the diametric distance between opposed corner portions, an inner cylindrical casing of the same material as said outer enclosure and being coaxially disposed therewithin and joined at its circumference in sealing relation only to said planar sections of said inner wall intermediate said corner portions thereof leaving thereby four corner spaces each bounded by a corner portion and that part of said inner casing, forming a partition, spaced from the corner portion, each partition being formed with openings to enable passage of granular material, when present in the inner casing, from the inner casing through said openings into said corner portions, a bag inlet communicating with an upper end of the inner casing enabling the charging of a powder material thereinto, and a bag outlet communicating with a bottom end of said inner casing enabling discharge of a powder material therefrom, covering means for covering said inlet, and a closure means for closing off said outlet.

2. A shipping bag as claimed in claim 1, wherein the length of the inner casing is shorter than that of the outer enclosure to provide an upper space and a lower space in the bag.

3. A shipping bag as claimed in claim 1 wherein there are provided additional partitions, each formed with a plurality of slits, in the four corner spaces to form double spaces in said corner portions of the external bag.

4. A shipping bag as claimed in claim 1, wherein lifting means are provided at opposed sides of the outer wall of the outer enclosure for enabling lifting movement of the bag.

* * * * *